United States Patent [19]

Pond et al.

[11] Patent Number: 5,057,854

[45] Date of Patent: Oct. 15, 1991

[54] MODULAR PARTIAL BARS AND FULL WIDTH ARRAY PRINTHEADS FABRICATED FROM MODULAR PARTIAL BARS

[75] Inventors: Stephen F. Pond, Pittsford; Donald J. Drake, Rochester; Robert P. Altavela, Pittsford; Gary A. Kneezel, Webster; Ivan Rezanka, Pittsford, all of N.Y.

[73] Assignee: Xerox Corporation, Stamford, Conn.

[21] Appl. No.: 543,550

[22] Filed: Jun. 26, 1990

[51] Int. Cl.[5] ..... B41J 2/155

[52] U.S. Cl. ..... 346/140 R; 346/75

[58] Field of Search ..... 346/140 R, 1.1, 75; 400/126; 29/890.1

[56] References Cited

U.S. PATENT DOCUMENTS

| | | | |
|---|---|---|---|
| 4,463,359 | 7/1984 | Ayata et al. | 346/1.1 |
| 4,534,814 | 8/1985 | Volpe et al. | 156/300 |
| 4,601,777 | 7/1986 | Hawkins et al. | 156/626 |
| 4,612,554 | 9/1986 | Poleshuk | 346/140 R |
| 4,638,328 | 1/1987 | Drake et al. | 346/75 |
| 4,774,530 | 9/1988 | Hawkins | 346/140 R |
| 4,786,357 | 11/1988 | Campanelli et al. | 156/633 |
| 4,829,324 | 5/1989 | Drake et al. | 346/140 R |
| 4,863,560 | 9/1989 | Hawkins | 156/644 |
| 4,899,181 | 2/1990 | Hawkins et al. | 346/140 R |
| 4,935,750 | 6/1990 | Hawkins | 346/140 R |

*Primary Examiner*—Benjamin R. Fuller

*Assistant Examiner*—Victor DeVito

*Attorney, Agent, or Firm*—Oliff & Berridge

[57] ABSTRACT

Modular partial bars include a substrate bar having a length and a plurality of printhead subunits attached to only one side of the substrate bar, each printhead subunit being spaced from an adjacent printhead subunit. These modular partial bars are used as building blocks to form full width staggered array printheads. When the printhead subunits are arranged on each substrate bar so that two substrate bars are capable of forming a full width staggered array printhead, each modular partial bar is referred to as a modular half bar. One modular half bar can be stacked on another modular half bar any number of ways. For example, two half bars can be stacked with their printhead subunit containing sides facing the same direction, away from one another or towards one another. When two half bars are stacked with their printhead subunit containing sides facing in the same direction, an ink manifold for supplying ink to the printhead subunits of the lower half bar can be provided in the substrate of the upper half bar. When half bars are arranged with their printhead subunit containing sides facing each other, a common ink supply manifold can be used to supply ink to all of the printhead subunits in the full width staggered array, thus eliminating the need for two separate ink supply manifolds. By modifying the construction of the channel plates typically used to form the printhead subunits, the need for a separate ink supply manifold can be entirely eliminated.

25 Claims, 3 Drawing Sheets

MODULAR PARTIAL BARS AND FULL WIDTH ARRAY PRINTHEADS FABRICATED FROM MODULAR PARTIAL BARS

BACKGROUND OF THE INVENTION

1. Field of the Invention

The present invention involves ink jet printheads, and in particular modular partial bars for fabricating full width printheads from smaller printhead subunits and full width staggered array printheads fabricated from these modular partial bars.

2. Description of Related Art

It is well known in the ink jet printhead industry to construct printheads from extended arrays of printhead subunits. The extended array approach is preferred over a monolithic approach, wherein a large printhead is constructed from a large unitary element, because the printhead subunit approach results in a higher yield of usable jets from the material used to construct the printheads (usually silicon wafers). This higher yield results because the subunit approach permits individual subunits to be tested prior to assembly into the full width printhead. For example, when constructing thermal ink jet printheads which include a plurality of nozzle defining channels having resistive heating elements therein, a single defective resistive element results in the entire full width printhead which includes over 2500 resistive elements being discarded in the monolithic approach whereas only the printhead subunit which contains the defective resistive heating element is discarded in the subunit approach. See, for example, U.S. Pat. No. 4,829,324 to Drake et.al. for a more detailed explanation of the advantages of the subunit approach over the monolithic approach.

When using the subunit approach, a plurality of printhead subunits can be butted against one another on one side of a substrate which also acts as a heat sink to form the full width extended array printhead. Alternatively, a staggered subunit approach can be used wherein a plurality of printhead subunits are arranged on opposite sides of a common substrate, such as a heat sink, so that spaces exist between each printhead subunit on each of the opposite sides of the common substrate with the printhead subunits on one side of the common substrate located opposite from the spaces on the other side of the common substrate. Although the printhead subunits 4 located on one side of substrate 2 are not capable of printing a continuous line of text which extends the full width of the recording medium (e.g. a sheet of paper), all of the printhead subunits 4 in the entire full width staggered array (i.e., the subunits 4 on both sides of substrate 2) are collectively capable of printing a continuous line of text across a sheet of paper. FIG. 1 illustrates a previous design of a full width staggered array printhead wherein a plurality of printhead subunits 4, each of which includes a plurality of nozzles 6 are arranged on opposite sides of a common heat sink substrate 2. Two ink supplying manifolds 8 are provided, one for the printhead subunits 4 located on each side of common substrate 2, to supply ink to each of the printhead subunits 4. Each printhead subunit 4 includes an ink fill hole in its surface which contacts the ink manifold 8. The/ink fill hole communicates an internal cavity of each ink manifold 8 with all of the nozzles 6 in each printhead 4. Printhead subunits usable in the full width staggered array printhead illustrated in FIG. 1 as well as for the present invention are disclosed, for example, in U.S. Pat. No. 4,786,357 to Campanelli et.al., the disclosure of which is herein incorporated by reference. A number of architectures for staggered array printheads are disclosed in U.S. Pat. No. 4,463,359 to Ayata et.al., the disclosure of which is herein incorporated by reference.

While previous staggered array printhead architectures may meet the basic requirements of a full width printhead, they have a number of practical problems. One problem is that the alignment (in X, Y, Z and respective thetas) of printhead subunits on one side of the common substrate to the printhead subunits on the other side of the common substrate is not straightforward to achieve. The two sided alignment problem is compounded by the need to cure the printhead subunits on both common substrate sides in place, which leads to complex assembly fixture configurations. Additionally, staggered array printheads constructed as in FIG. 1 also require two-sided assembly and packaging. This means that two-sided wire bonding and encapsulation, as well as two-sided assembly and sealing of the ink manifold is required. This requires assembly process research and development and removes the process from standard commercial practices. Yet another problem is a potentially heavy penalty in printhead subunits lost in rejected full width printheads. After the printhead subunits are bonded to the common substrate, one bad or clogged printhead subunit results in the disposal of the entire common substrate and all of the good printhead modules contained thereon.

U.S. Pat. No. 4,829,324 to Drake et.al. discloses a full width array ink jet printhead constructed from a plurality of printhead subunits each of which includes a heater plate having a plurality of resistive heating elements thereon and a channel plate having a plurality of nozzle defining channels formed in one surface thereof. A number of printhead subunit arrangements for forming one-sided full width printheads using the butting approach are disclosed.

U.S. Pat. No. 4,786,357 to Campanelli et.al. discloses a method for fabricating thermal ink jet printheads from two silicon wafers. A plurality of heater plate subunits are formed in one silicon wafer and a plurality of channel plate subunits are formed in another silicon wafer, the two silicon wafers are bonded to one another so that each heater plate subunit on the first silicon wafer corresponds to a channel plate subunit on the other silicon wafer. The bonded silicon wafers are then separated between each of the subunits to form a plurality of fully functional thermal ink jet printhead subunits.

U.S. Pat. No. 4,612,554 to Poleshuk discloses an ink jet printhead composed of two identical parts, each having a set of parallel V grooves anisotropically etched therein. The lands between the grooves each contain a heating element and its associated addressing electrode. The grooved parts permit face-to-face mating, so that they are automatically self-aligned by the intermeshing of the lands containing the heating element and electrodes of one part with the grooves of the other part. A pagewidth printhead is produced by offsetting the first two mated parts, so that subsequently added parts abut each other and yet continue to be self-aligned.

U.S. Pat. No. 4,534,814 to Volpe et.al. discloses a large scale printhead made up of rows of styli patterned onto glass substrates sandwiched between rugged support substrates. Multiple rows of styli are accomplished by stacking. Each row of styli is constructed from butted segments.

U.S. Pat. No. 4,863,560 to Hawkins discloses a method of fabricating channel plates for ink jet printheads from silicon wafers using orientation dependent etching techniques.

OBJECTS AND SUMMARY OF THE INVENTION

It is an object of the present invention to provide a full width printhead wherein the assembly procedures and precision fixtures required for assembling the printhead are greatly simplified.

It is another object of the present invention to provide a full width printhead wherein little modification of commercial packaging techniques is required.

It is another object of the present invention to provide a construction for full width printheads wherein the number of printhead subunits lost due to defective elements is reduced.

A further object of the present invention is to provide a full width printhead construction wherein the number of parts is reduced and the ink supplied to the individual printhead subunits can be utilized for dissipating heat from the subunits.

To achieve the foregoing and other objects, and to overcome the shortcomings discussed above, modular partial bars are disclosed which include a substrate bar having a length and a plurality of printhead subunits attached to only one side of the substrate bar, each printhead subunit being spaced from an adjacent printhead subunit. These modular partial bars are used as building blocks to form full width staggered array printheads. When the printhead subunits are arranged on each substrate bar so that two substrate bars are capable of forming a full width staggered array printhead, each modular partial bar is referred to as a modular half bar. To form a full width staggered array printhead from two modular half bars, one modular half bar is stacked on another modular half bar any number of ways. For example, the two half bars can be stacked with their printhead subunit containing sides facing the same direction, away from one another or towards one another. When two half bars are stacked with their printhead subunit containing sides facing in the same direction, an ink manifold for supplying ink to the printhead subunits of the lower half bar can be provided in the substrate of the upper half bar. Placing an ink manifold in the substrate of a half bar, which substrate is also used as a heat sink, also allows the ink in the manifold to be used to further dissipate heat from the printhead. When the half bars are arranged with their printhead subunit containing sides facing each other, a common ink supply manifold can be used to supply ink to all of the printhead subunits in the full width staggered array, thus eliminating the need for two separate ink supply manifolds. Alternatively, by modifying the construction of the channel plates typically used to form the printhead subunits, the need for a separate ink supply manifold can be entirely eliminated. Regardless of the arrangement of the half bars to each other, should one of the printheads become clogged or defective, only the half bar containing the defective printhead subunit needs to be replaced instead of replacing the entire full width array.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

While the specific examples described below relate to modular partial bars which have a plurality of printhead subunits arranged on only one side thereof so that two modular partial bars are capable of forming a full width staggered array printhead and are thus referred to as modular half bars, other arrangements which require more than two modular partial bars are within the scope of the present invention. For example, it is possible to form modular partial bars by arranging printhead subunits on only one side of substrate bars so that three or even four modular partial bars are required to form a full width staggered array printhead capable of printing a continuous line of text. Such modular partial bars would be referred to as modular third bars or modular quarter bars, respectively. Thus, more than one modular partial bar is required to form a full width staggered array printhead which is capable of printing a continuous line of text across the full width of, for example, a sheet of paper. Although the staggered array printhead is capable of printing a continuous line of text across its entire length, each modular partial bar is incapable of printing a continuous line of text due to the spacing which exists between each printhead subunit on the substrate bar.

Figure 1:
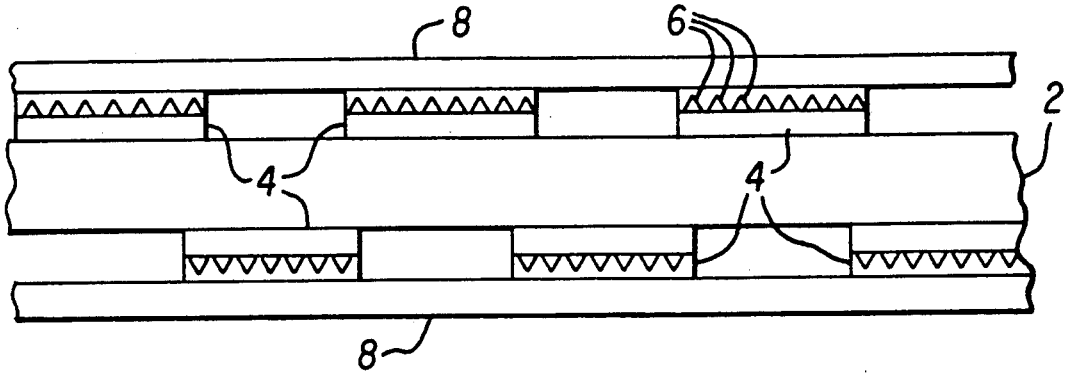
FIG. 1 (PRIOR ART)
FIG. 1 is a partial front view of a full width staggered array printhead constructed using a prior art technique.
Figure 2:
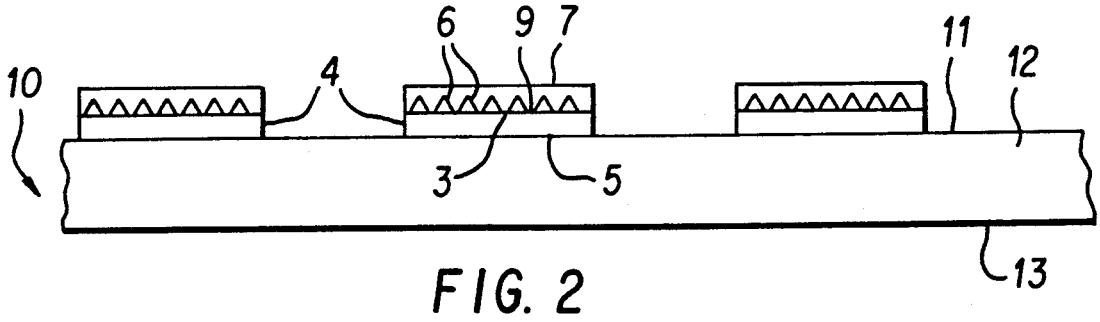
FIG. 2 is a partial front view of a half bar according to the present invention wherein a plurality of printhead subunits are arranged on only one side of a substrate bar.

FIG. 2 shows a partial front view of a modular half bar 10 constructed according to the present invention. Modular half bar 10 includes a substrate bar 12 having a plurality of printhead subunits 4 bonded to only one side 11 thereof. Although modular half bar 10 is incapable of printing a continuous line of text due to the spaces which exist between each printhead subunit 4 thereon, the subunits 4 are arranged on substrate bar 12 so that when two half bars 10 are stacked upon each other so that the subunits 4 of each half bar 10 are staggered, a full width staggered array printhead capable of printing a continuous line of text, is formed. Substrate bar 12 also includes a second side 13 opposite from side 11. Substrate bar 12 can have a length equal to the entire width of the final product full width staggered array printhead (for example, substrate bar 12 can have a length corresponding to the width of a page when fabricating a pagewidth printhead) or substrate bar 12 can have a length less than the width of the final product full width staggered array printhead. When the length of substrate bar 12 is less that the width of the final product printhead, two or more substrate bars 12 are butted lengthwise to each other until they form a combined length equal to the width of the final product full width printhead. Substrate bar 12 is preferably a heat sink, although it need only perform the function of acting as a support for the plurality of printhead subunits 4. When used as a heat sink, substrate 12 should be made from materials which have a high thermal conductivity and a low thermal expansion coefficient. Materials such as metals, graphite, and the like can be used as a heat sink material.

Printheads 4 generally include a first surface 5 which is bonded to side 11 of substrate bar 12 and a second surface 7 opposite from first surface 5. A plurality of ink jet nozzles 6 are formed in a front face of each printhead 4 and function to emit droplets of ink towards a recording medium (e.g., paper). Printhead subunits 4 can be any of a variety of types. For example, printhead subunits 4 can be of the thermal ink jet type wherein a resistive heating element is located in a channel which leads to each nozzle 6 and generates droplets from each nozzle 6 when heated by having an electrical impulse applied thereto. See, for example, the above-incorporated U.S. Pat. Nos. 4,463,359 and 4,786,357 as well as U.S. Pat. Nos. 4,829,324 to Drake et.al. and 4,601,777 to Hawkins et.al., the disclosures of which are herein incorporated by reference. Other types of ink jet printheads include the "continuous stream" type wherein a continuous stream of droplets are emitted from nozzles 6 and are potentially synchronized by either piezoelectric actuators or thermal energy pulses and the droplets are selectively charged and deflected away from the recording medium to form images thereon. See for example, U.S. Pat. No. 4,638,328 to Drake et. al., the disclosure of which is herein incorporated by reference. Other types of ink jet devices can also be used with the present invention as long as the subunit approach is applicable thereto.

The figures illustrate a thermal ink jet printhead wherein each subunit 4 includes a heater plate having its first surface 5 bonded to side 11 of substrate bar 12 and a second side 3 having a plurality of resistive heating elements formed thereon. Each thermal ink jet printhead subunit 4 also includes a channel plate having a first surface 9 which includes a plurality of nozzle defining channels therein and which is bonded to second surface 3 of the heater plate subunit. A second surface 7 of channel plate subunit commonly includes an ink fill hole 27 (see FIG. 8) which supplies ink from a source to nozzles 6. Ink fill hole 27 can be formed to have a variety of configurations, but generally extends from second surface 7 to first surface 9 of the channel plate subunit and is placed in communication with the channels which define nozzles 6 either by removing a portion of the channel plate subunit between fill hole 27 and the channels by for example, milling or etching or by placing a groove in a polyimide layer which is formed on the heater plate subunit which communicates fill hole 27 with the channels in channel plate 6. See, for example, U.S. Pat. No. 4,774,530 to Hawkins, the disclosure of which is herein incorporated by reference, for a construction wherein a channel is formed in a polyimide layer located on surface 3 of a heater plate subunit. See the above-incorporated U.S. Pat. No. 4,601,777 for an example of a construction wherein a portion of the channel plate subunit is removed between fill hole 27 and the channels which form nozzles 6.

Printhead subunits 4 are located on substrate bar 12 so that each printhead subunit 4 is spaced a distance from an adjacent subunit which is greater than zero. Thus, a space is provided on substrate bar 12 between each printhead subunit 4, which space can be used for containing wiring for attaching each subunit 4 to a daughterboard, or for containing supply means for supplying ink to each printhead subunit 4. The space between each printhead subunit 4 is preferably less than the width of each subunit 4 when forming half bars so that when two half bars are stacked, one upon another, the two combined half bars will form a full width printhead capable of printing a continuous line of text having the width of, for example, a page. However, it is possible to provide a space between each printhead subunit which is greater than the width of each subunit if more than two modular partial bars will be used to form the final product full width staggered array printhead. For example, modular third, or quarter bars can be provided with spaces between each printhead subunit which are greater than the width of the printhead subunits, as long as the staggered array printhead formed by stacking three or four of these modular partial bars, respectively, is capable of printing a continuous line of text. The distance between each printhead subunit is usually also greater than one-half the width of a single subunit 4, although lesser amounts of spacing can also be provided, particularly if a higher density of ink spots per inch (spi) is required to be produced by the printhead.

Figure 3A:
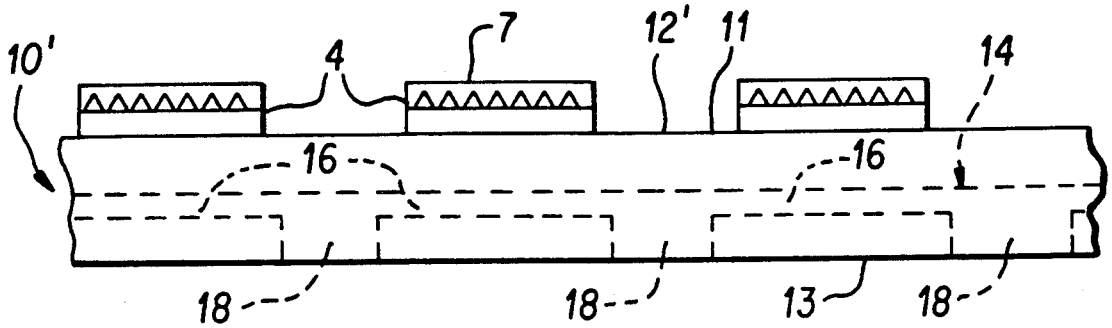
FIGS. 3A and 3B are partial front views of half bars according to the present invention wherein an ink manifold is formed in the substrate bar.

FIG. 3A illustrates half bar 10' which is a modification of half bar 10 shown in FIG. 2. Half bar 10' includes a substrate bar 12, similar to substrate bar 12 in that it has a plurality of printhead subunits 4 spacedly arranged on only side 11 thereof. Substrate bar 12' differs from that shown in FIG. 2 in that it includes a bore 16 therethrough which defines an ink manifold 14. A plurality of ink supply holes 18 extend through second side 13 of substrate bar 12' and are for communicating bore 16 of ink manifold 14 with the ink fill holes 27 contained in surface 7 of each printhead subunit 4. Modular half bar 10' can be used to form full width staggered array printheads by stacking a plurality of half bars 10' on each other with their printhead containing sides 11 facing in the same direction. By arranging the half bars 10' so that ink supply holes 18 communicate with the ink fill holes 27 of the printhead subunit located on a lower half bar, only a single ink supply manifold 8 is required to form a full width staggered array printhead regardless of the number of rows of half bars used (see FIG. 8). Thus, the number of manifolds required to form a full width staggered array printhead is reduced. Additionally, by incorporating the ink supply manifold 14 in substrate bar 12', heat which is generated by the printhead subunits is dissipated from substrate bar 12' by the ink in manifold 14.

Figure 3B:
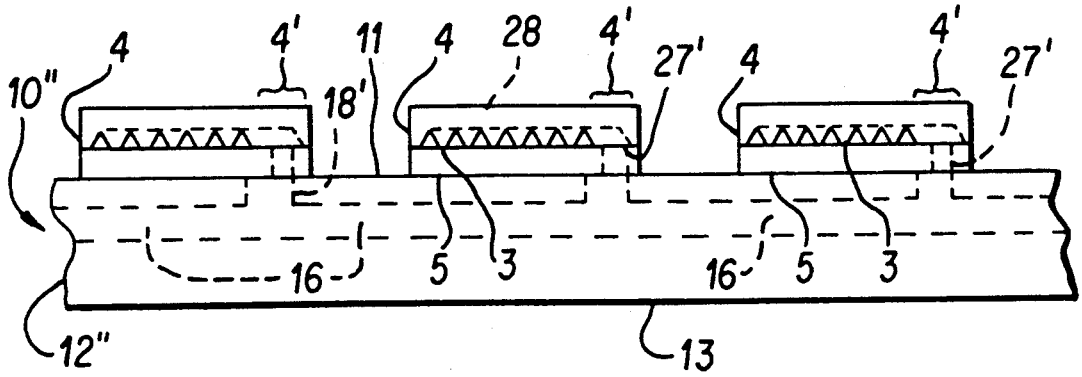

As noted above, the space between each printhead subunit 4 on substrate bar 12 can be utilized to contain structure for providing ink to each printhead subunit 4. For example, the need for ink fill hole 27 located in second surface 7 of the channel plate can be eliminated by supplying ink to each printhead subunit 4 through an ink fill hole 27' formed in the lower surface 5 of each heater plate. Such an ink supply architecture is illustrated in FIG. 3B and can be formed by widening each channel plate and heater plate on one side to produce an extension 4' which extends beyond the nozzle forming channels and resistive heating elements into the space which is available between each printhead subunit 4 on a substrate bar 12''. Fill hole 27' can then be formed through this extension of the heater plate from first surface 5 to second surface 3 of the heater plate. Fill hole 27' can be formed by orientation dependent etching (ODE), laser, sand blasting or other appropriate techniques. Fill hole 27' formed through the heater plate is communicated with the nozzle forming channels of the channel plate by fluidwise communicating the fill hole 27' with a common channel 28, formed in the channel plate or in the polyimide layer of the heater plate, which fluidwise communicates with all of the nozzle forming channels in the printhead subunit 4. Ink is then supplied to each printhead subunit 4 on substrate bar 12'' by forming a bore 16 through the length of substrate bar 12'' and providing a plurality of supply holes 18' in the substrate bar 12'', one for each printhead subunit, which extend from bore 16 to the first surface 11 of the substrate bar 12'' and communicate with fill hole 27' in first surface 5 of the heater plate of each subunit 4. This construction is advantageous because each modular partial bar 10'' containing such an ink supply architecture is fully operational without requiring additional ink supply structure (such as separate manifolds) and the ink also aids in dissipating heat from substrate bar 12''.

Figure 4:
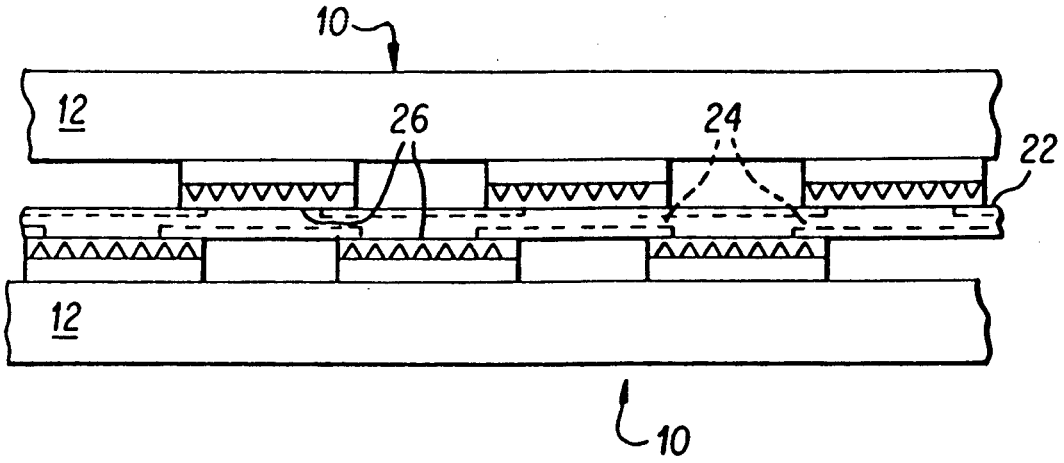
FIG. 4 is a partial front view of a full width staggered array printhead made from two half bars arranged with their printhead subunit containing sides facing one another with a common ink supply manifold therebetween.

FIG. 4 illustrates a full width staggered array printhead fabricated from two modular half bars 10 wherein the half bars 10 are arranged with their printhead subunit containing sides 11 facing each other. An ink supply manifold 22 is provided for supplying ink to all the printhead subunits 4 in the entire full width staggered array printhead. Ink supply manifold 22 includes an internal cavity 24 and a plurality of ink supply holes 26 formed therein. Ink supply holes 26 communicate internal cavity 24 with the ink fill holes 27 formed in each printhead subunit 4 to supply ink thereto. The arrangement illustrated in FIG. 4 also eliminates the need for two separate ink supply manifolds 8 as was previously required.

Figure 5:
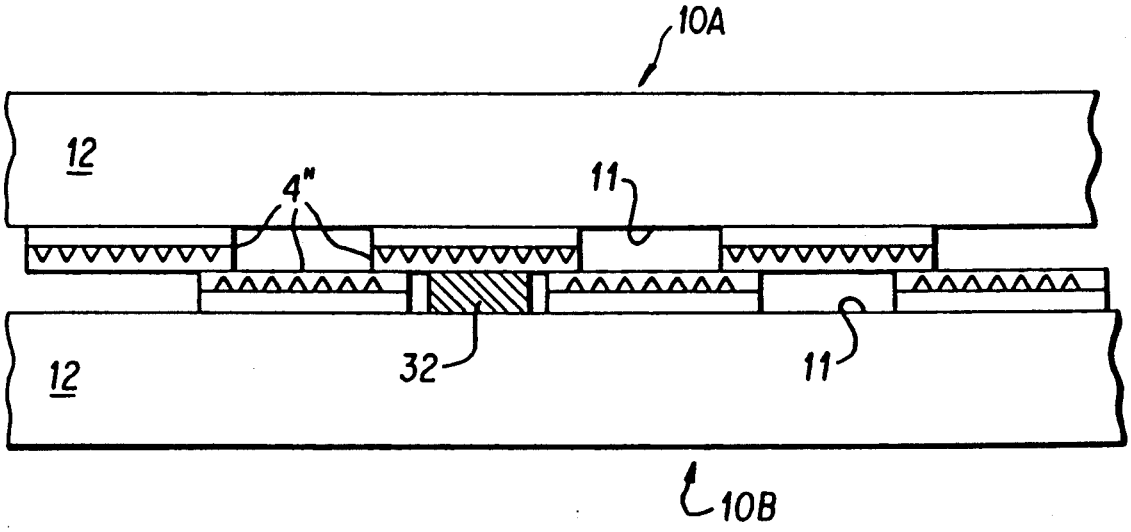
FIG. 5 is a partial front view of a full width staggered array printhead according to the present invention wherein two half bars are arranged as in FIG. 4, except the individual printhead subunits are modified so that no ink supply manifold is required.
Figure 6:
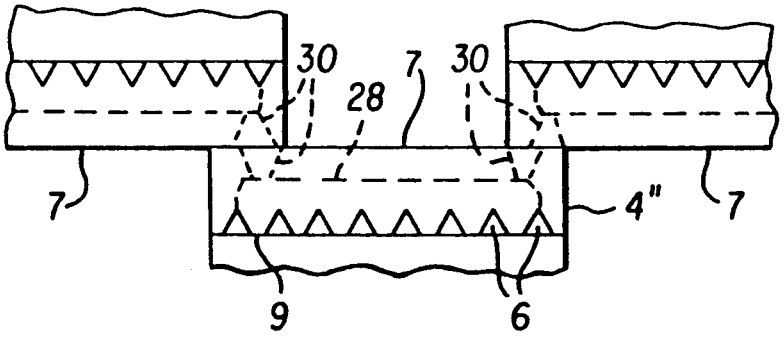
FIG. 6 is a partial front view of the printhead subunits used in the full width staggered array printhead of FIG. 5 and illustrates the ink fill holes on the printhead subunits which eliminate the need for an ink supply manifold.

FIG. 5 illustrates an embodiment of the present invention wherein two half bars 10A, 10B are arranged with their printhead subunit containing sides 11 facing towards each other and the printhead subunits 4,, are modified so that no ink supply manifold is required. As shown in FIG. 6, printhead subunits 4'' include ink fill holes 30 located adjacent each of opposite sides of each printhead subunit 4''. The ink fill holes 30 communicate with a common channel 28 formed on the channel containing surface 9 of the channel plate which places ink fill holes 30 in fluid communication with each of the channels that define nozzles 6. Fill holes 30 are located adjacent each side of every printhead subunit 4'' in the array. The printhead subunits 4'' are arranged on each of the modular half bars so that second surfaces 7 of each printhead subunit 4'' of each modular half bar 10A, 10B contact the second surfaces 7 of two adjacent printhead subunits 4'' on the opposite modular half bar 10B, 10A, respectively, adjacent their sides. Consequently, one of the fill holes 30 of each printhead subunit 4'' is in fluid communication with one of the fill holes 30 of each of the printhead subunits 4'' which it contacts, thus placing all of the printhead subunits 4'' in the array in series fluid communication with each other. By placing one of the printhead subunits 4'' in the entire array in communication with a source of ink, all of the nozzles 6 in the entire printhead will be supplied with ink. One of the printhead subunits 4'' can be placed in communication with a source of ink, for example, by accessing common channel 28 from the rear or side surface of the subunit 4''.

FIG. 6 illustrates one construction for supplying ink to each printhead subunit 4'' in the array configuration of FIG. 5, however other constructions are possible. For example, printhead subunits 4 having fill hole 27 centrally located in surface 7 can be used in the array configuration of FIG. 5 if a manifold (such as manifold 32, illustrated by broken lines and shaded in FIG. 5) is provided between each of the subunits 4 on side 11 of the modular half bar 10B for providing ink to the printhead subunits 4 on the other half bar 10A and vice versa. Each manifold 32 can be supplied with ink from behind or through substrate 12 in a manner similar to that illustrated in FIG. 3B. Alternatively, each printhead subunit 4 can be individually supplied with ink by accessing a common channel in each subunit 4 which communicates with all of the nozzles 6 (such as common channel 28) from a rear or side surface of each printhead subunit 4, or through first surface 5 of the heater plate as shown in FIG. 3B. In particular, the spaces which exist between each printhead subunit 4 on each substrate 12 can be utilized to provide space for structure for accessing a common channel (such as common channel 28) from a side of each printhead subunit 4. In this manner, the spaces between subunits 4 which inherently exist in the staggered subunit approach are fully utilized. One advantage of the printhead subunit construction illustrated in FIG. 6, wherein all of the printhead subunits are in series fluid communication with each other is that only one of the printhead subunits 4'' in the entire full width array needs to be accessed by an ink supply means.

It is understood that common channel 28 does not have to be located in surface 9 of the channel plate, but can also be located in the polyimide (or other material) layer on surface 3 of the heater plate as shown in the above-incorporated U.S. Pat. No. 4,774,530. Thus, any number of communication means can be provided in each printhead subunit 4 as long as the communication means interconnects all of the nozzles 6 in each subunit 4 and provides access to an external supply of ink. Furthermore, any number of supply means can be provided for supplying ink to the printhead subunits such as, for example, separate manifolds which supply ink to one or both of the half bars in a full width staggered array, a manifold formed in a substrate 12'' or 12'' of a half bar 10'' or 10' for supplying ink to printhead subunits on the substrate or of another half bar, or various structures which access one or more printhead subunits from upper, lower, rear or side surfaces thereof.

Figure 7:
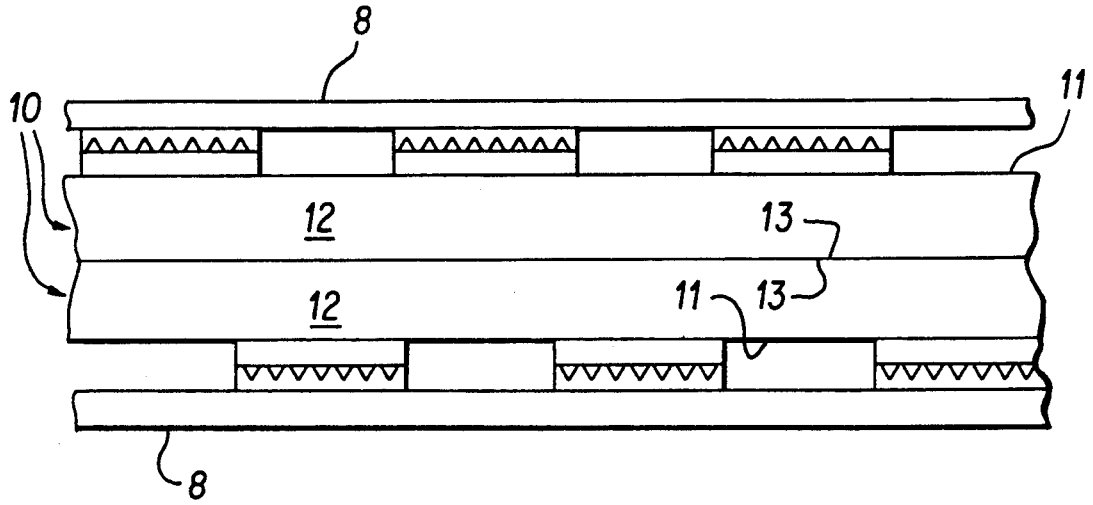
FIG. 7 is a partial front view of a full width staggered array printhead wherein two half bars are arranged with their printhead subunit containing sides facing away from each other.

FIG. 7 illustrates an embodiment of the present invention wherein two half bars 10 are arranged so that their printhead subunit containing sides 11 face away from each other and their opposite sides 13 contact each other. This arrangement resembles the prior art full width staggered array printheads in that two separate ink supply manifolds 8 can be used to supply all of the printhead subunits 4 in the array with ink. However, an advantage of the arrangement illustrated in FIG. 7 (as well as every other embodiment of the present invention) over the prior arrangements is that should one of the printhead subunits 4 in the entire array become defective, only the half bar on which the defective subunit 4 is attached needs to be discarded and thus, only half as many printhead subunits are lost when a defect occurs.

Figure 8:
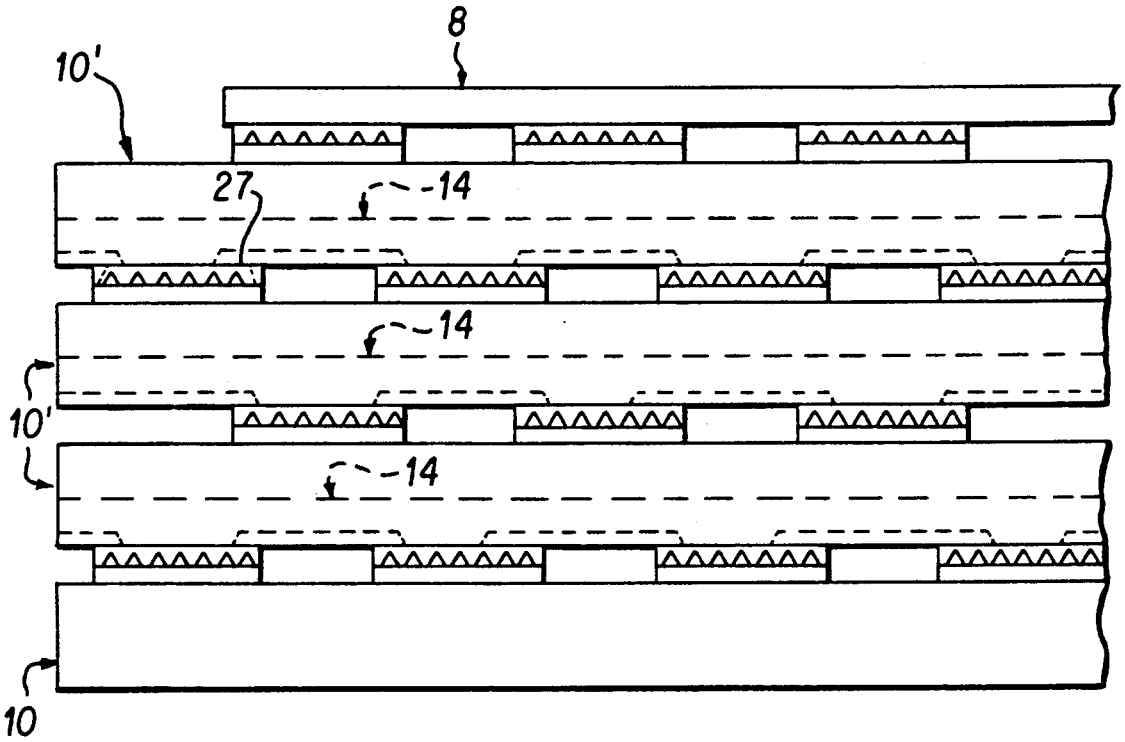
FIG. 8 is a partial front view of a two color full width staggered array printhead made from stacked modular half bars.

FIG. 8 is a partial front view of a two color full width staggered array printhead made from four stacked half bars. In the embodiment shown in FIG. 8, the lower two half bars are used to expel ink having a first color and the upper two half bars are used to expel ink having a second color. It is understood that while a two-color full width printhead is illustrated, more colors can be provided simply by stacking more pairs of half bars. Additionally, while all of the half bars in FIG. 8 are arranged with their printhead subunit containing sides 11 facing the same direction, other arrangements can also be used.

While the present invention is described with reference to thermal ink jet printheads, these particular embodiments are intended to be illustrative, not limiting. Additionally, while the modular partial bars illustrated are of the half bar type (i.e. two modular partial bars can be stacked to form a full width staggered array printhead), other architectures, such as for example, modular third bars and modular quarter bars, are also possible. Various modifications may be made without departing from the spirit and scope of the invention as defined in the appended claims.

What is claimed is:

1. A modular partial bar which can be used to form a staggered array printhead, comprising:

a substrate bar having a length, a first planar side, and a second side opposite from said first planar side, said substrate bar being made from a heat sink material; and a plurality of printhead subunits attached to only said one planar side of said substrate bar, each printhead subunit being spaced from an adjacent printhead subunit by a distance greater than zero, each of said printhead subunits including: a heater plate subunit having a first planar surface bonded to said one planar side of said substrate bar, and a second surface opposite from said first planar surface and having a plurality of resistive heater elements thereon; and a channel plate subunit having a first surface which includes a plurality of channels therein corresponding in number and location to said plurality of resistive heater elements in said heater plate subunit, said first surface of said channel plate subunit being bonded to said second surface of said heater plate subunit so that a resistive heater element is located in each channel, each channel plate subunit also including communication means for fluid communicating the channels on each channel plate subunit with a supply of ink;

wherein no heater plate subunits are directly attached to said second side of said substrate bar so that said substrate bar functions as a support for said plurality of printhead subunits attached to said first planar side of said substrate bar.

2. The modular partial bar according to claim 1, wherein each printhead subunit substantially equal widths and is spaced from an adjacent printhead subunit by a distance less than the width of said subunits.

3. The modular partial bar according to claim 2, wherein said distance is also greater than one-half the width of said subunits.

4. The modular partial bar according to claim 1, further comprising supply means, in fluid communication with said communication means of at least one of said printhead subunits, for supplying ink to said at least one said communication means.

5. The modular partial bar according to claim 1, wherein said communication means includes at least one fill hole extending through the second surface of each channel plate subunit and being in fluid communication with said plurality of channels of each channel plate subunit.

6. The modular partial bar according to claim 5, further comprising a hollow ink supply manifold attached to the second surface of each channel slate subunit in the substrate bar, said ink supply manifold having a plurality of supply holes placing an internal cavity of said ink supply manifold in fluid communication with each fill hole.

7. The modular partial bar according to claim 5, wherein each channel plate subunit has two fill holes, one fill hole being located adjacent a corresponding one of opposite sides of each channel plate subunit, and a further channel extending across substantially an entire width of each channel plate subunit and fluid connecting the plurality of channels of each channel pate subunit with said two fill holes.

8. The modular partial bar according to claim 4, wherein said supply means includes a bore extending through the length of said substrate bar and a plurality of ink supply holes, corresponding in number and location to said plurality of printhead subunits, each of said plurality of ink supply holes extending from said bore to said one planar side of said substrate bar and being in fluid communication with the communication means of a corresponding channel plate subunit.

9. The modular partial bar according to claim 1, wherein said substrate bar has a bore defining an ink manifold extending through said substrate bar along said length of said substrate bar, and a plurality of ink supply holes extending from said bore to said second side of said substrate bar, each of said ink supply holes being spaced from an adjacent ink supply hole and being located on said second side of said substrate bar opposite from spaces formed between each printhead subunit.

10. The modular partial bar according to claim 1, wherein said printhead subunits are spaced so that said modular partial bar is incapable of printing a continuous line of text.

11. A full width staggered array printhead comprising:

a first modular half bar including a first substrate bar made from a heat sink material and having a length, a first planar side, a second side opposite from said first planar side, and a first set of printhead subunits attached to only said one planar side of said first substrate bar, each of said printhead subunit which is greater than zero so that spaces exist on said one planar side between each printhead subunit, wherein said first substrate bar functions as a support for said first set of printhead subunits; and a second modular half bar including a second substrate bar made from a heat sink material and having a length, a first planar side, a second side opposite from said first planar side, and a second set of printhead subunits attached to only said one planar side of said second substrate bar, each of said pinrthead subunits in said second set of printhead subunits being spaced from an adjacent printhead subunit by a distance equal to the distance between adjacent printhead subunits in said first set of printhead subunits so that spaces exist on said one planar side of said second substrate bar between each printhead subunit, wherein said second substrate bar functions as a support for said second set of printhead subunits;

each printhead subunit including a heater plate subunit having a first planar surface bonded to said one planar side of a corresponding one of said first and second substrate bars and a second surface opposite from said first planar surface and having a plurality of resistive heater elements thereon, and a channel plate subunit having a first surface which includes a plurality of channel therein corresponding in number and location to said plurality of resistive heater elements on said heater plate subunit, said first surface of said channel plate subunit being bonded to said second surface of said heater plate subunit so that a resistive heater element is located in each channel, each channel plate subunit also including communication means for fluid communicating the channels of each channel plate subunit with a supply of ink;

wherein no heater plate subunits are directly attached to said second side of either of said first substrate bar and said second substrate bar;

said first modular half bar being stacked on said second modular half bar so that the first set of printhead subunits is staggered with the second set of printhead subunits.

12. The full width staggered array printhead according to claim 11, further comprising supply means, in fluid communication with at least one of said communication means of at least one said communication means.

13. The full width staggered array printhead according to claim 11, wherein said communication means including at least one fill hole extending through the second surface of each channel plate subunit and being in fluid communication with the channels of said channel plate subunit.

14. The full width staggered array printhead according to claim 13, wherein said first and second modular half bars are arranged with said one planar side of said first substrate bar and said one planar side of said second substrate bar facing in a same direction.

15. The full width staggered array printhead according to claim 14, wherein said second side of said first substrate bar is attached to the second surface of each channel plate subunit of said second modular half bar, said first substrate bar having a bore therethrough and a plurality of ink supply holes therein extending from said bore to said second side of said first substrate bar, each ink supply hole being spaced from an adjacent ink supply hole and being located on said second side of said first substrate bar opposite from the spaces formed between each printhead subunit attached to said one planar side of said first substrate bar, each ink supply hole placing said bore in fluid communication with at least one said fill hole of a corresponding channel plate subunit attached to said one planar side of said second substrate bar.

16. The full width staggered array printhead according to claim 15, further comprising a hollow ink supply manifold attached to the second surface of each channel plate subunit of said first modular half bar, said ink supply manifold having a plurality of supply hole placing an internal cavity of said ink supply manifold in fluid communication with each fill hole of said channel plates in said first set of printhead subunits.

17. The full width staggered array printhead according to claim 13, wherein said first and second modular half bars are arranged with said one planar side of said first substrate bar and said one planar side of said second substrate bar facing towards each other.

18. The full width staggered array printhead according to claim 17, further comprising a hollow ink manifold located between said first and second modular half bars, said hollow ink manifold being attached to the second surface of each channel plate subunit on both the first and second modular half bars and including a plurality of holes, said plurality of holes placing an internal cavity of said ink manifold in fluid communication with a fill hole of a corresponding one of said channel plate subunits of said first and second sets of printhead subunits.

19. The full width staggered array printhead according to claim 17, wherein each channel plate subunit includes two fill holes, one fill hole being located adjacent a corresponding one of opposite sides of each channel plate subunit, said first and second modular half bars being arranged so that the second surfaces of each channel plate subunit of one of said first and second modular half bars contacts the second surfaces of two adjacent channel plate subunits on one of the second and first modular half bars, respectively, except for one end channel plate subunit of each of the first and second modular half bas which contacts a single channel plate subunit of the second and first modular half bars, respectively, wherein on of the fill holes of each channel plate subunit is in fluid communication with one of the fill holes of each of the channel plate subunits which each said channel plate subunit contacts so that all of the channels of all of the channel plate subunits in the array are in series fluid communication with each other.

20. The full width staggered array printhead according to claim 13, wherein said first and second modular half bars are arranged with said one planar side of said first substrate bar and said one planar side of said second substrate bar facing away from each other.

21. The full width staggered array printhead according to claim 20, further comprising first and second hollow ink supply manifolds attached to the second surface of each channel plate subunit of said first and second modular half bars respectively, each ink supply manifold having a plurality of holes, each of which places an internal cavity of the respective ink supply manifold in fluid communication with each fill hole of a corresponding channel stage.

22. The full width staggered array printhead according to claim 11, wherein said first and second modular half bars are arranged with said one planar side of said first substrate bar and said one planar side of said second substrate bar facing in a same direction.

23. The full width staggered array printhead according to claim 11, wherein said first and second modular half bars are arranged with said one planar side o said first substrate bar and said one planar side of said second substrate bar facing towards each other.

24. The full width staggered array printhead according to claim 11, wherein said first and second modular half bars are arranged with said one planar side of said first substrate bar and said one planar side of said second substrate bar facing away from each other.

25. A full width staggered array printhead comprising:

at least two modular partial bars, each modular partial bar including a substrate bar made from a heat sink material and having a length, a first planar side, a second side opposite from said first planar side, and a set of printhead subunits attached to only said one planar side of a corresponding substrate bar, each printhead subunit on each substrate bar being spaced an equal distance from an adjacent printhead subunit which is greater than zero so that spaces exist between each printhead subunit on said one planar side of the substrate bar of each modular partial bar, wherein each substrate bar functions as a support for the set of printhead subunits attached to said one planar side;

each printhead subunit including a heater plate subunit having a first planar surface bonded to said one planar side of a corresponding substrate bar and a second surface opposite from said first planar surface and having a plurality of resistive heater elements thereon, and a channel plate subunit having a first surface which includes a plurality of channel wherein corresponding in number and location to said plurality of resistive heater elements on said heater plate subunit, said first surface of said channel plate subunit being bonded to said second surface of said heater plate subunit so that a resistive heater element is located in each channel, each channel plate subunit also including communication means for fluid communicating the channels of each channel plate subunit with a supply of ink;

wherein no heater plate subunits are directly attached to said second side of said substrate bars;

said at least two said modular partial bars being stacked one upon another so that printhead subunits on all of the modular partial bars together define a full width staggered array printhead capable of printing a continuous line of text along substantially an entire length of said full width staggered array printhead.

* * * * *